United States Patent [19]

Kobayashi

[11] 4,118,899

[45] Oct. 10, 1978

[54] HEAD STOCK FOR GRINDING MACHINE

[75] Inventor: Akiyoshi Kobayashi, Kariya, Japan

[73] Assignee: Toyoda-Koki Kabushiki-Kaisha, Japan

[21] Appl. No.: 795,448

[22] Filed: May 10, 1977

[30] Foreign Application Priority Data

Jun. 10, 1976 [JP] Japan ..... 51-68154

[51] Int. Cl.[2] ..... B24B 41/04

[52] U.S. Cl. ..... 51/237 R; 82/28 R

[58] Field of Search ..... 51/236, 237 R; 82/28 R

[56] References Cited

U.S. PATENT DOCUMENTS

| | | | |
|---|---|---|---|
| 1,428,190 | 9/1922 | Stoner | 82/28 R |
| 2,113,362 | 4/1938 | Amidon | 82/28 R |
| 2,419,622 | 4/1947 | Anderson | 82/28 R |

*Primary Examiner*—Harold D. Whitehead
*Attorney, Agent, or Firm*—Oblon, Fisher, Spivak, McClelland & Maier

[57] ABSTRACT

A head stock for a grinding machine for dead and live center drives. For dead center drive, one end of an engaging member, which is radially slidably received in a flange portion of a spindle, is engaged with an engaging member secured to a housing, while the other end thereof is free from interference with a face plate secured to a pulley. For live center drive, one end of the engaging member is disengaged from the engaging member, while the other end thereof is engaged with the face plate to rotate therewith. For a chucking operation, another face plate is secured to the spindle and is selectively engaged with the pulley, with the one end of the engaging member being disengaged from the engaging member.

5 Claims, 6 Drawing Figures

HEAD STOCK FOR GRINDING MACHINE

BACKGROUND OF THE INVENTION

1. Field of the Invention

The present invention relates to a head stock for selective use between dead and live center drives of a spindle in a grinding machine.

2. Description of the Prior Art

In the grinding operation with a grinding machine, it is usual to use the dead center drive for working a workpiece held by centers and to use the live center drive for working a workpiece having a large center opening or a workpiece held by a chuck. For this reason, in a grinding machine, such as a universal grinding machine, adapted to perform both inner and outer grinding operations, the head stock is constructed such that the drive of the workpiece can be readily switched between the live center drive and the dead center drive.

A conventional head stock for switching the drive between the live center and the dead center drive is shown in FIGS. 1 and 2 of the drawings. Therein, a spindle 3 holding a center 2 and a pulley 4 coaxial with the spindle 3 are rotatably mounted within a head stock housing 1. The pulley 4 is driven by belts connected to a transmission for reducing the rotation of a motor. At the end surface of the pulley 4 are secured a face plate 5 having a dog 5a for rotating a workpiece and a claw 6, adjustable in a radial direction. A recess 7, associated with the claw 6, is formed on the outer periphery of a spindle 3. A switching pin 8 is movably received in the head stock housing 1. An engaging groove 9, engageable with the switching 8, is formed on the spindle 3. For the dead center drive, the claw 6 is moved out of engagement with the recess 7 and the switching pin 8 is moved into engagement with the groove 9, as shown in FIG. 1, whereas for the live center drive, the claw 6 is moved into engagement with the recess 7 and the switching pin 8 is removed from engagement with the groove 9.

In order to perform the chucking operation, the face plate 5, secured to the end surface of the pulley 4, and the center 2 are removed and a chuck 11 is secured to the end surface of the spindle 3, through a face plate 10, as shown in FIG. 2. At the same time, the claw 6 is moved into engagement with the recess 7 and the switching pin 8 is moved away from the groove 9 of the spindle 3.

In this manner, the drive for the spindle 3 can be changed between the dead and live center drives. However, in the conventional device of this type, two operations are required for the claw 6 and the switching pin 8, and the operator may forget one of these operations. In particular, since the claw 6 is usually made invisible by the existence of the face plate 5, the operator may fail to operate the same, to thereby cause the often occurring trouble.

In the chucking operation, the connection between the pulley 4 and the spindle 3 is accomplished by the claw 6. However, the claw 6 cannot be operated as long as the face plate 10 is secured. Furthermore, since the pulley 4 is connected to the motor through the transmission, it is difficult to rotate the chuck by a manual operation.

SUMMARY OF THE INVENTION

It is therefore an object of the present invention to provide a new and improved head stock for a grinding machine capable of ensuring the changeover between the dead and live center drives to present inadvertent failure to complete the switching operation because of forgetfulness.

Another object of the present invention is to provide a new and improved head stock for a grinding machine capable of easily rotating a chuck by a manual operation in the chucking operation.

Briefly, according to the present invention, these and other objects are achieved by providing a head stock for a grinding machine, as mentioned below. A spindle is rotatably mounted in a housing and is provided at one end thereof with a radially recessed groove. A pulley is rotatably mounted on the housing in coaxial relation with the spindle. A first engaging member is secured at one end thereof to the housing between the pulley and the spindle, and is provided at the other end thereof with a notch. A second engaging member is slidably received in the groove of the spindle and is engageable at one end thereof with the notch of the first engaging member. The other end of the second engaging member is projected beyond the spindle. A face plate is securable to the pulley and is provided with an annular groove and an engaging portion engageable with the other end of the second engaging member. Means are provided for selectively positioning the second engaging member at a first position, where the one end of the second engaging member is engaged with the notch of the first engaging member and the other end thereof is disengaged from the engaging portion of the face plate secured to the pulley and received in the annular groove of the face plate, and at a second position, where the one end of the second engaging member is disengaged from the notch of the first engaging member and the other end thereof is engaged with the engaging portion of the face plate secured to the pulley.

BRIEF DESCRIPTION OF THE DRAWINGS

The foregoing and other objects and many of the attendant advantages of the present invention will be readily appreciated as the same becomes better understood by reference to the following detailed description, when considered in connection with the accompanying drawings, in which.

DETAILED DESCRIPTION OF THE PREFERRED EMBODIMENT

Figure 1:
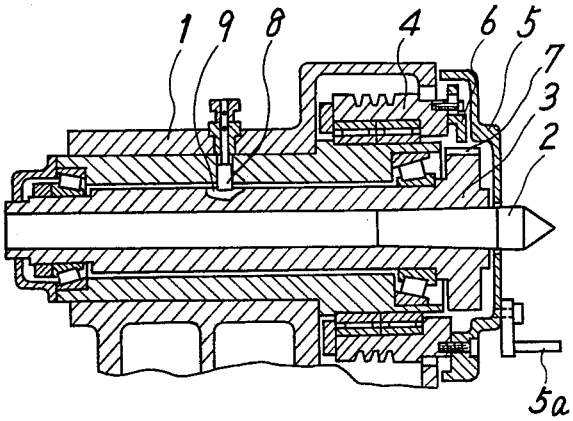
Fig. 1 PRIOR ART
FIGS. 1 and 2 are sectional views of main component parts of a conventional head stock.
Figure 2:
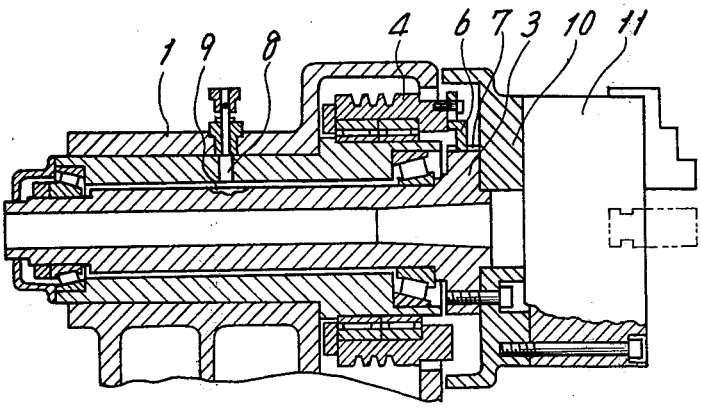
Fig. 2 PRIOR ART
Figure 3:
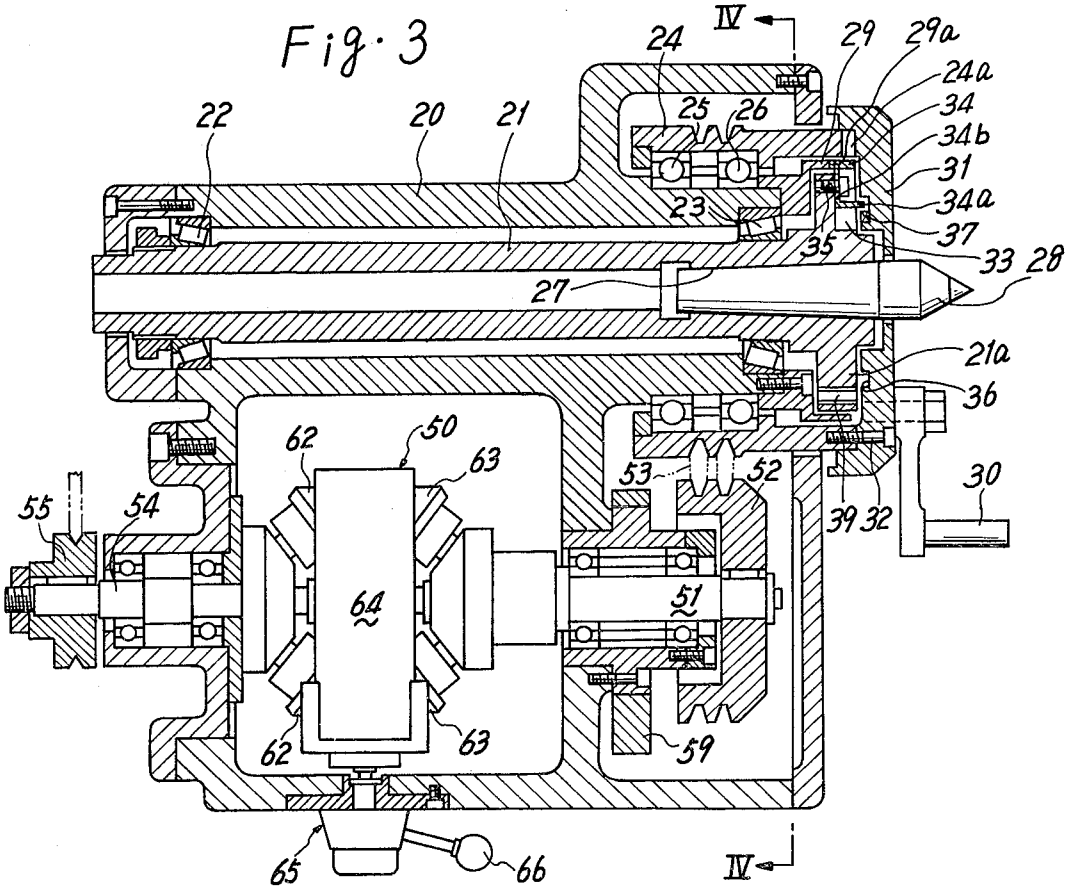
FIG. 3 is a sectional view of a head stock according to the present invention.
Figure 4:
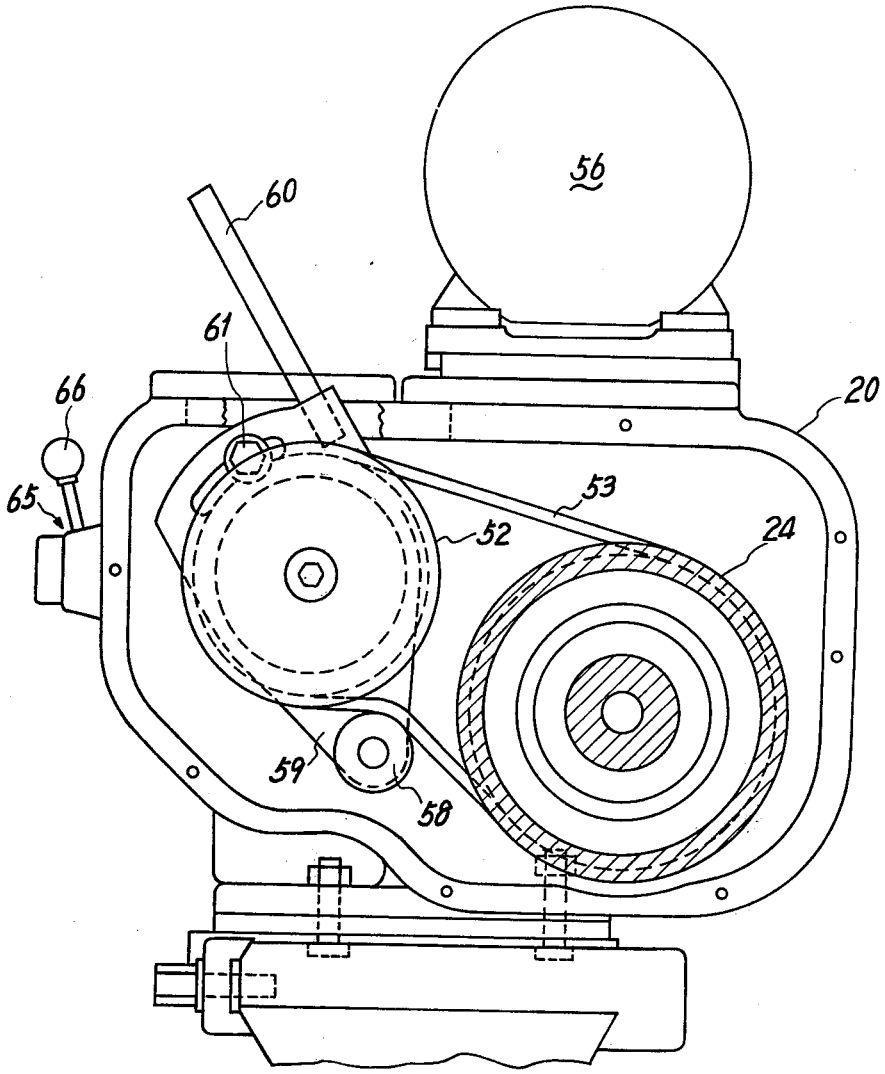
FIG. 4 is a sectional view taken along the lines IV—IV in FIG. 3.

Referring now to the drawings, wherein like reference numerals or characters refer to identical or corresponding parts throughout the several views, and more particularly to FIGS. 3 and 4, there is shown a head stock housing 20 mounted on a table of a grinding machine. A spindle 21 is rotatably mounted within the head stock housing 20 through bearings 22 and 23. A pulley 24 is rotatably supported on the head stock housing 20 through bearings 25 and 26 in coaxial relation with the spindle 21. The pulley 24 is connected by belts 53 to a pulley 52 secured on an output shaft 51 of a transmission 50 for providing an infinitely variable speed. A pulley 55 secured on an input shaft 54 of the transmission 50 is connected by belts to a pulley secured on an output shaft of a motor 56 mounted on the head stock housing 20. A tension pulley 58 for adjusting the tension of the belts 53 for the pulleys 24 and 52 is rotatably mounted on a swing support 59, which is pivotably mounted on the head stock housing 20, as shown in FIG. 4. A manual lever 60 is connected to the swing support 59 and projected from the head stock housing 20. A bolt 61 is provided to fix the swing support 59 in position.

As shown in FIG. 3, the transmission 50 comprises conical frustums 62 provided at the side of the input shaft 54, conical frustums 63 provided at the side of the output shaft 51, a ring 64 engaging the outer peripheries of the conical frustrums 62 and 63 and a shift mechanism 65 for the ring 64. By rotating an operation lever 66, connected to the shift mechanism 65, the ring 64 is moved to change the position of contacts with the conical frustums 62 and 63, to infinitely change the speed of the output shaft 51.

The spindle 21 is provided with a tapered bore 27 to hold a center 28 at one end thereof and has a flange portion 21*a* integrally formed therewith at the one end. A cup-shaped engaging member 29 is secured at the bottom thereof to the head stock housing 20. The bottom of the engaging member 29 has a bore at the center thereof to receive the spindle 21, and the skirt or peripheral portion thereof is disposed between the outer peripheral surface of the flange portion 21*a* of the spindle 21 and the inner surface of the pulley 24 and has a notch 29*a* at the end surface thereof. The pulley 24 is provided at one end surface thereof with an engaging recess 24*a*, to be engageable with an engaging pin 43 mounted on a face plate 38, for mounting a chuck, as will be described hereinafter.

Figure 5:
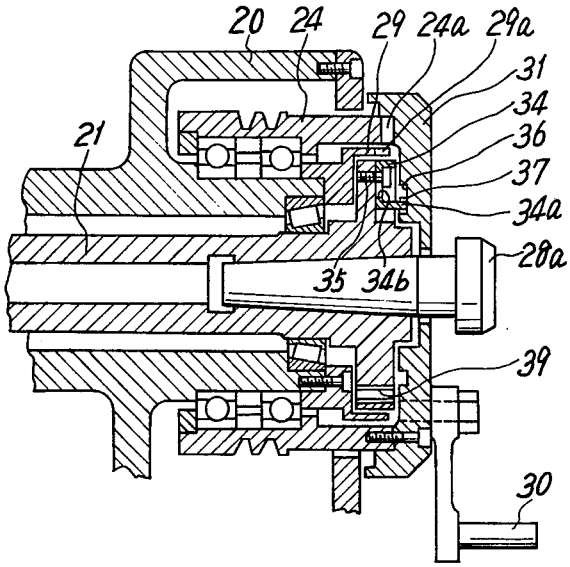
FIG. 5 is a sectional view of main component parts for the live center drive.

A face plate 31 is secured at one end thereof to the one end surface of the pulley 24 by bolts 32 and is provided at the other end thereof with a dog 30 for driving a workpiece held by centers. The flange portion 21*a* of the spindle 21 is provided with a radially recessed groove 33 to receive an engaging member 34 therein. One end of the engaging member 34 is engageable with the notch 29*a* of the engaging member 29. The other end 34*a* of the engaging member 34 is projected beyond the end surface of the flange portion 21*a*. The engaging member 34 is provided with an elongated hole 34*b* to receive a fixing bolt 35. The fixing bolt 35 is threaded into the end surface of the flange portion 21*a* to clamp the engaging member 34, either at a first position where the one end thereof is engaged with the notch 29*a* so that the engaging member 34 and the spindle 21 are restrained from rotation, as shown in FIG. 3, or at a second position where the one end thereof is disengaged from the notch 29*a*, as shown in FIG. 5. An annular groove 36 is formed on the inside surface of the face plate 31 to receive the projection 34*a* of the engaging member 34 being positioned at the first position to thereby permit rotation of the face plate 31. When the engaging member 34 is positioned at the first position, the center 28 is used for the dead center drive. An engaging recess 37 is formed on the face plate 31 adjacent to groove 36 to receive the projection 34*a* of the engaging member 34 being positioned at the second position, as shown in FIG. 5. At the second position, the engaging member 34 is disengaged from the notch 29*a* and engaged with the recess 37 to thereby permit bodily rotation of the face plate 31 and the spindle 21. When the engaging member 34 is positioned at the second position, the center 28*a* is used for the live center drive to support a workpiece having a large center opening. When the head stock is under the condition of the live center, it is possible to regrind the center 28 or 28on the machine.

Figure 6:
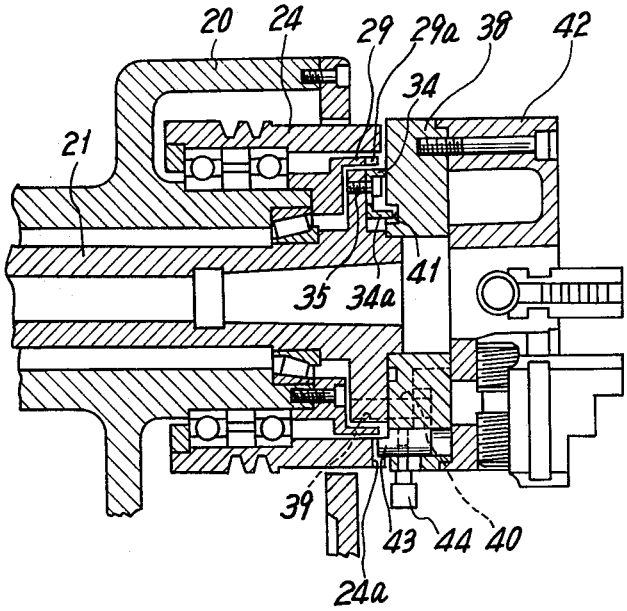
FIG. 6 is a sectional view of main component parts for the mounting of a chuck.

In order to switch the head stock for the chucking operation, the face plate 31 and the center 28 or 28*a* are dismounted, and the engaging member 34 is moved into the second position for disengagement from the notch 29*a* by loosening the fixing bolt 35. Thereafter, as shown in FIG. 6, the face plate 38 for mounting the chuck is attached to the end surface of the flange portion 21*a* of the spindle 21 and is clamped thereto by a bolt 40 threadedly engaged with a thread portion 39 formed on the flange portion 21*a* of the spindle 21. The face plate 38 is provided with an annular groove 41 which prevents interference with the projection 34*a* only when the engaging member 34 is located at the second position. Accordingly, the face plate 38 cannot be mounted unless the engaging member 34 is positioned at the second position to permit rotation of the spindle 21. A chuck 42 is mounted on the face plate 38. The engaging pin 43, engageable with the recess 24*a* on the pulley 24, is guided in the face plate 38 and is provided with an operation knob 44 projected from the outer periphery of the face plate 38. Operation of the knob 44 to move the engaging pin 43 into engagement with the recess 24*a* of the pulley 24 causes the chuck 42 to rotate with the pulley 24, and the disengagement of the pin 43 from the recess 24*a* effects to disconnect the chuck 42 from the pulley 24, to thereby permit free rotation of the chuck by manual operation. Accordingly, it is possible to inspect the run-out of a workpiece held by the chuck 42 for an easy centering operation.

As described above, according to the present invention, the switching between the dead and live centers in the center operation is accomplished only by positioning adjustment of the engaging member 34 received in the recessed groove 33 of the spindle 21 so that there is no possibility of forgetful failure of one of the operations, as observed in the conventional device, and positive switching is assured. The switching between the dead and live center drives can be performed by the common engaging member 34 and the mountings of the face plate with the dog 30 and the face plate for the chuck require the positionings of the engaging member 34 at the first and second positions, respectively. Accordingly, the operational failure of the switching by the engaging member 34 can be prevented from occuring, to eliminate any possibility of the troubles.

Furthermore, provision of the pin 43 on the face plate 38, for engagement with and disengagement from the pulley 24, enables the selective rotation of the chuck 42 either by manual operation or by an electric motor, to thereby provide an easy centering operation of a workpiece.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A head stock for a grinding machine comprising:

a housing;

a spindle rotatably mounted within said housing and provided at one end thereof with a radially recessed groove;

a pulley rotatably mounted on said housing in coaxial relation with said spindle and provided at one end thereof with an engaging recess;

a first engaging member secured at one end thereof to said housing between said pulley and said spindle, and provided at the other end thereof with a notch;

a second engaging member slidably received in the groove of said spindle and being engageable at one end thereof with the notch of said first engaging member;

the other end of said second engaging member being projected beyond said spindle;

a first face plate detachably secured to said pulley and provided with an annular groove and an engaging portion engageable with the other end of said second engaging member;

means for selectively positioning said second engaging member at a first position, where the one end of said second engaging member is engaged with the notch of said first engaging member and the other end thereof is disengaged from the engaging portion of said first face plate secured to said pulley and received in the annular groove of said first face plate, and at a second position, where the one end of said second engaging member is disengaged from the notch of said first engaging member and the other end thereof is engaged with the engaging portion of said first face plate secured to said pulley;

a second face plate detachably secured to said spindle and provided with an annular groove capable of receiving the other end of said second engaging member only when the second engaging member is disengaged from the notch of said first engaging member;

an engaging pin slidably received in said second face plate to be engageable with the engaging recess of said pulley;

means connected to said engaging pin for selectively engaging said engaging pin with the engaging recess of said pulley;

a chuck secured to said second face plate; and said first and second face plates being selectively secured to said pulley and said spindle, respectively.

2. A head stock as claimed in claim 1, wherein said spindle has a flange portion which is formed with said radially recessed groove.

3. A head stock as claimed in claim 2, wherein said first engaging member is a cup-shaped member, the bottom portion thereof being secured to said housing and provided with a bore to receive said spindle and the skirt portion thereof being provided with the notch and positioned between said pulley and the flange portion of said spindle.

4. A head stock as claimed in claim 1, wherein the engaging portion of said face plate is formed adjacent the annular groove of said face plate.

5. A head stock as claimed in claim 2, wherein said positioning means comprises an elongated hole formed on said second engaging member, and a fixing bolt threaded into the flange portion of said spindle to clamp said second engaging member either at the first or the second position.

* * * * *